US008118512B2

(12) United States Patent
Samartgis

(10) Patent No.: US 8,118,512 B2
(45) Date of Patent: Feb. 21, 2012

(54) BRUSH OR MOP OR LIKE TOOL

(75) Inventor: Jim Samartgis, Etham Victoria (AU)

(73) Assignee: The Decor Corporation Pty Ltd., Scoresby, Victoria (AU)

( * ) Notice: Subject to any disclaimer, the term of this patent is extended or adjusted under 35 U.S.C. 154(b) by 601 days.

(21) Appl. No.: 12/300,608

(22) PCT Filed: May 29, 2007

(86) PCT No.: PCT/AU2007/000749

§ 371 (c)(1),
(2), (4) Date: Nov. 12, 2008

(87) PCT Pub. No.: WO2007/137354

PCT Pub. Date: Dec. 6, 2007

(65) Prior Publication Data

US 2009/0285621 A1 Nov. 19, 2009

(30) Foreign Application Priority Data

Jun. 1, 2006 (AU) ..... 2006902962

(51) Int. Cl.

| | |
|---|---|
| ***A46B 11/04*** | (2006.01) |
| ***A46B 11/00*** | (2006.01) |
| ***A47L 1/08*** | (2006.01) |
| ***A47L 13/00*** | (2006.01) |
| ***A47L 13/22*** | (2006.01) |

(52) U.S. Cl. ..... 401/280; 401/119; 401/138

(58) Field of Classification Search ..... 401/280, 401/138, 270, 205, 179, 196; 137/846, 587
See application file for complete search history.

(56) References Cited

U.S. PATENT DOCUMENTS

| | | | | |
|---|---|---|---|---|
| 1,767,079 | A * | 6/1930 | Kenyon | 401/1 |
| 3,186,024 | A * | 6/1965 | McLemore | 401/150 |
| 4,225,254 | A * | 9/1980 | Holberg et al. | 401/119 |
| 4,458,711 | A * | 7/1984 | Flider | 137/71 |

(Continued)

FOREIGN PATENT DOCUMENTS

| | | |
|---|---|---|
| DE | 41 14 794 | 11/1992 |

(Continued)

OTHER PUBLICATIONS

International Searching Authority, International Search Report—International Application No. PCT/AU2007/000749, dated Jun. 19, 2007, together with the Written Opinion of the International Searching Authority, 5 pages.

(Continued)

*Primary Examiner* — Dinh Nguyen
*Assistant Examiner* — Chee-Chong Lee
(74) *Attorney, Agent, or Firm* — Sunstein Kann Murphy & Timbers LLP

(57) ABSTRACT

A brush, or mop, or like tool (1) has a handle (5) and a head (7). The handle (5) is able to carry a liquid that can be dispensed therefrom during use of the tool (1). The handle (5) has a liquid dispensing passage (51) through which the liquid can pass to an outlet (17). The passage (51) has a valve (19) to control the passage of the liquid and the valve (19) has a sliding gate part (65) and a stationary gate part (49). The sliding gate part (65) can be positionable to block the flow of liquid in one position, and to permit the flow of liquid in another position. The sliding gate part (65) effects a sliding wiping cleaning of the valve (19), and therefore minimize clogging of the valve (19).

12 Claims, 4 Drawing Sheets

U.S. PATENT DOCUMENTS

| | | | | |
|---|---|---|---|---|
| 5,511,341 | A * | 4/1996 | Payne | 47/79 |
| 6,083,002 | A * | 7/2000 | Martin et al. | 433/90 |
| 2008/0107471 | A1 * | 5/2008 | Fitzpatrick et al. | 401/138 |

FOREIGN PATENT DOCUMENTS

| | | |
|---|---|---|
| DE | 200 00 472 | 4/2000 |
| WO | WO 01/97654 | 12/2001 |
| WO | WO 2004/077995 | 9/2004 |

OTHER PUBLICATIONS

*International Preliminary Report on Patentability*, International Application No. PCT/AU2007/000749 Completed: May 14, 2008.

*International Preliminary Report on Patentability* (Corrected Version), International Application No. PCT/AU2007/000749 Completed: Aug. 1, 2008.

* cited by examiner

BRUSH OR MOP OR LIKE TOOL

FIELD OF THE INVENTION

This invention relates to a brush, or mop, or like tool, and relates particularly but not exclusively to a toilet brush with an elongate handle.

BACKGROUND ART

Hitherto, there have been many proposals for producing brushes, mops or like tools that carry a liquid, such as a cleaning liquid, and wherein the liquid can be dispensed during operation of the brush, or mop, or like tool to facilitate use. Toilet brushes have been previously proposed that have a mechanism to permit the dispensing of a cleaning liquid, such as a disinfectant. Toothbrushes have also been proposed that include toothpaste which can be released during operation of the brush. Many other forms of brushes, mops, or like tools have been proposed, and various valve mechanisms have been utilised to enable the liquid to be dispensed as required by an operator. In some dish brushes, a hollow handle contains a dish washing liquid. Apertures are provided at the head end and when the user squeezes the handle it causes the dish washing liquid to be dispensed. Dish washing brushes of this type are particularly wasteful of the contents because during normal use, the handle is gripped which, in turn, applies pressure to the liquid contents which causes unwanted dish washing liquid to be dispensed. Further, such dish washing brushes allow the liquid contents to be unintentionally discharged when the brush is merely lying on a surface such as in a cupboard.

The known prior art brushes, mops, or like tools have suffered from a problem of blocked outlets or control valves, which necessitates dismantling and cleaning of the valve or otherwise manipulating tools external of the tools to clear the outlets or valves. In some cases, "pricking" wires are required to be inserted into the outlets where the liquid is dispensed. This can damage the valves and/or the outlets.

STATEMENTS OF THE INVENTION

There is a need for an alternative brush, mop or like tool.

According to a first broad aspect of the present invention there is provided a brush, or mop like tool, comprising a head and a handle extending from said head, said handle being able to carry a liquid that can be dispensed therefrom to provide a dispensed liquid useable during operation of the brush or mop or like tool, said handle including a liquid dispensing passage through which said liquid can pass to a liquid outlet during liquid dispensing, said passage having a valve for controlling a passage of said liquid, said valve including a sliding gate part and a stationary gate part, said sliding gate part being positionable relative to said stationary gate part to block the flow of liquid when in one position, and to be positionable relative to said stationary gate part in another position to permit the flow of liquid, said sliding gate part effecting a sliding wiping cleaning of the valve during movement from said one position to said another position.

Preferably, the brush, or mop, or like tool is a toilet brush and wherein the handle is an elongate handle intended to be held in an upright disposition during use, and wherein said outlet is at a head end of the brush.

Preferably, the valve has a sliding gate part mounted so that it can slide in a direction across the handle and generally perpendicular to a longitudinal central axis of the handle.

Most preferably, the sliding gate part is caused to slide by being associated with a dispensing operator carried by the handle, so that when said dispensing operator is moved to dispense liquid, the sliding gate part will slide relative to the fixed gate part.

Most preferably the sliding gate part is an elongate part that can be held stationary at one end relative to the stationary gate part, and which can be elongated longitudinally by an operation of the dispensing operator so that the other end will slide relative to the stationary gate part, and permit the flow of liquid so liquid can be dispensed from said outlet.

BRIEF DESCRIPTION OF DRAWINGS

In order that the invention can be more clearly ascertained an example of a preferred embodiment of a toilet brush will now be described with reference to the accompanying drawings wherein.

DETAILED DESCRIPTION OF EXAMPLES OF PREFERRED EMBODIMENTS

Figure 1:
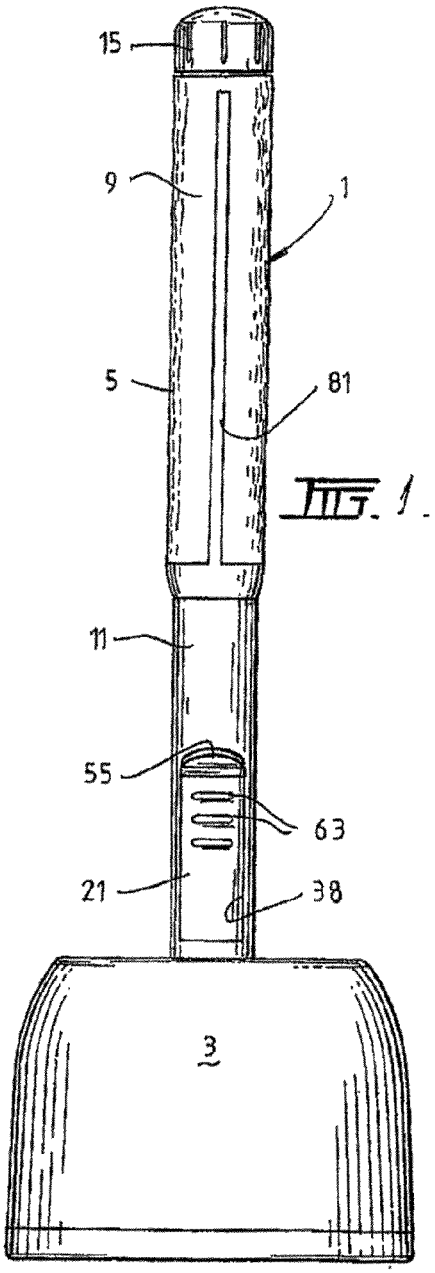
FIG. 1 is a front side elevation view of an example of a preferred embodiment resting in a base.

Referring firstly to FIG. 1, there is shown a front side elevational view of a toilet brush 1 seated in a base 3. It should be appreciated that the invention is applicable to brushes, mops, or like tools and is not limited to toilet brushes per se.

Figure 2:
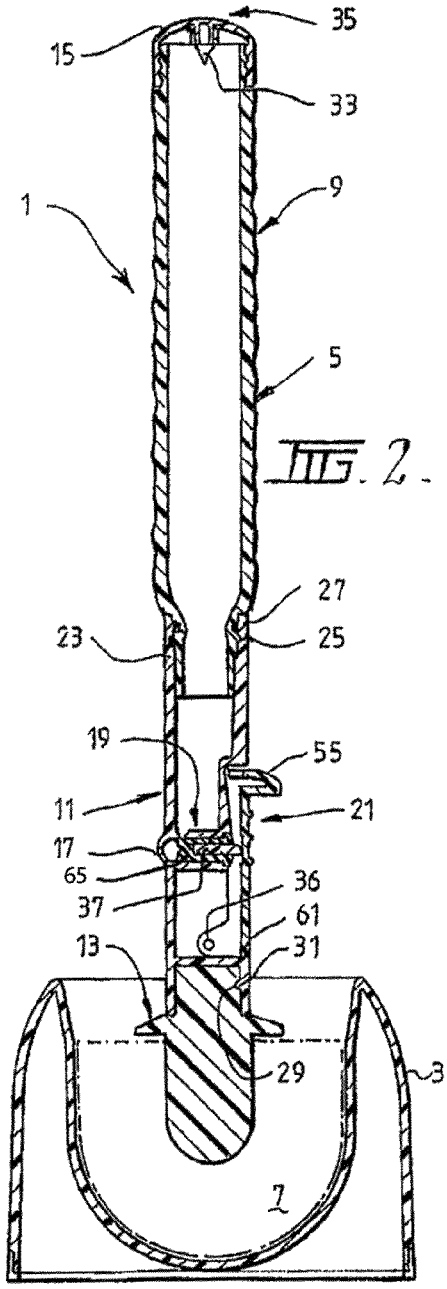
FIG. 2 is a transverse cross sectional view taken from one side of FIG. 1.
Figure 3:
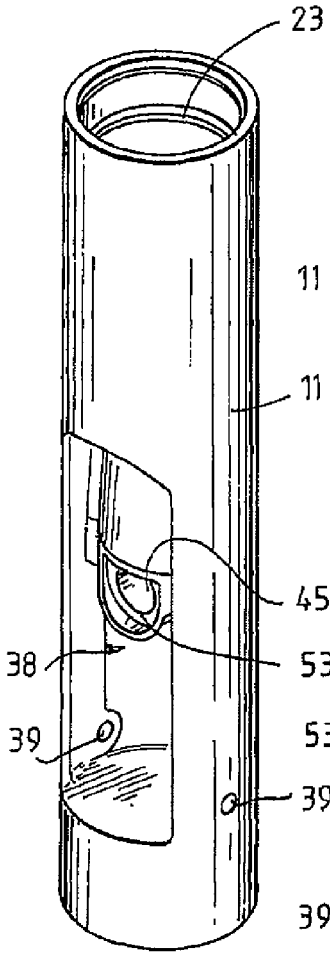
FIG. 3 is a top perspective view of an intermediate part of the handle.
Figure 4:
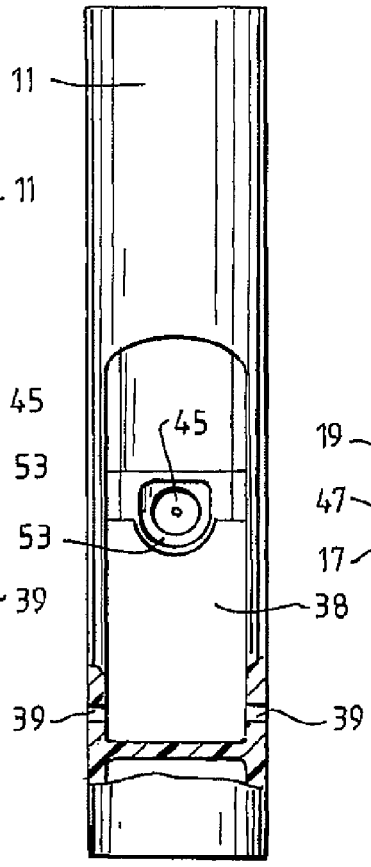
FIG. 4 is a side elevational view of the intermediate part shown in FIG. 3.
Figure 5:
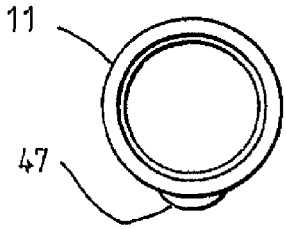
FIG. 5 is a plan view of the intermediate part shown in FIGS. 3 and 4.
Figure 6:
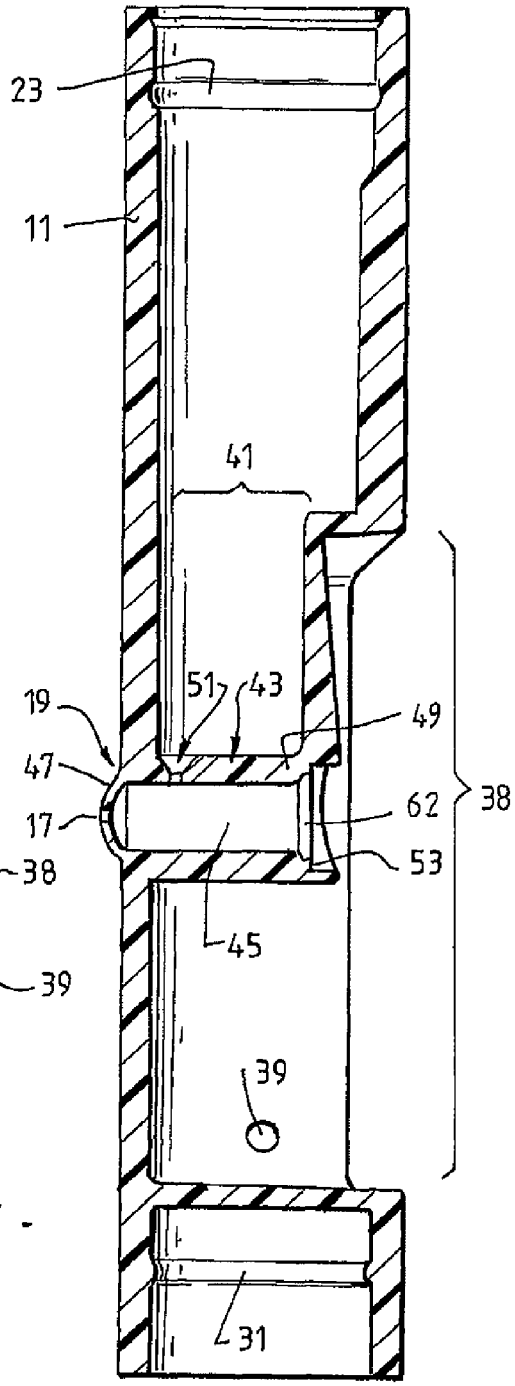
FIG. 6 is a longitudinal cross sectional view through the intermediate part shown in FIGS. 3-5.
Figure 7:
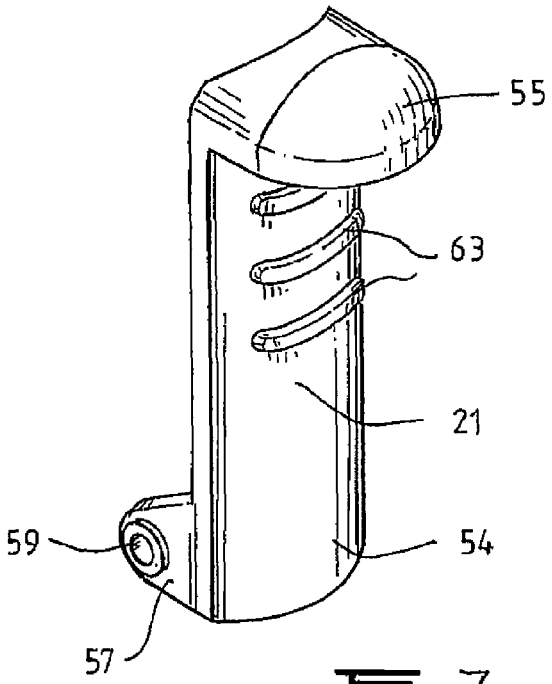
FIG. 7 is a top perspective view of a dispensing operator.
Figure 8:
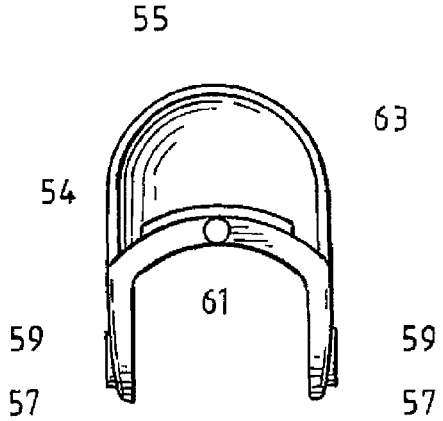
FIG. 8 is an underneath view of the dispensing operator shown in FIG. 7.
Figure 9:
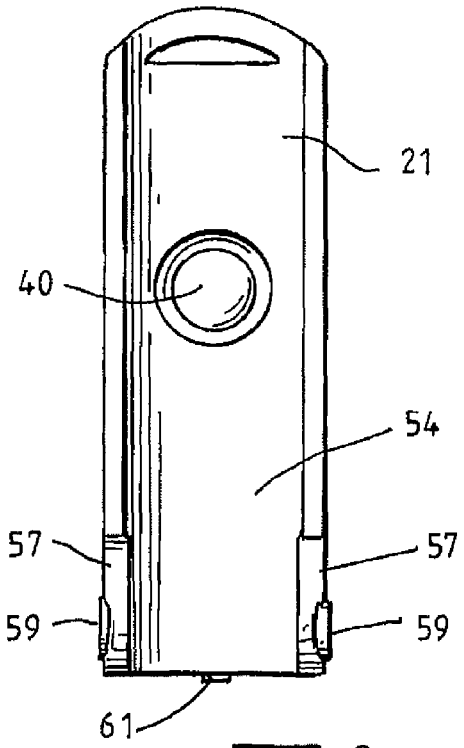
FIG. 9 is a rear elevational view of the dispensing operator shown in FIGS. 7 and 8.
Figure 10:
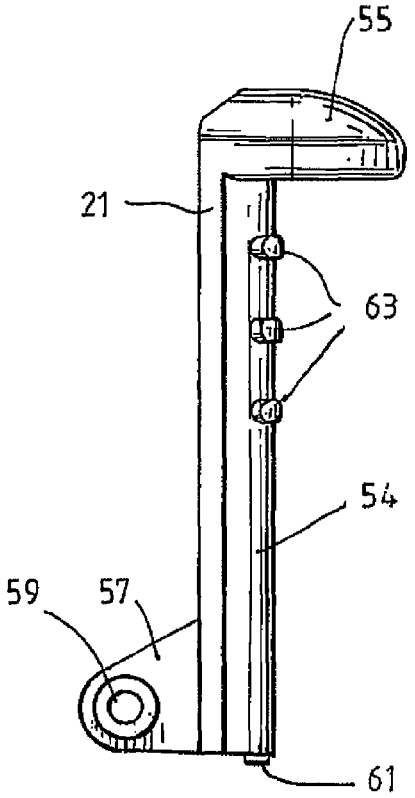
FIG. 10 is a side elevational view of the dispensing operator shown in FIGS. 7-9.

Reference will now be made to FIG. 2 which is a transverse cross sectional side elevation view of the example. Here it can be seen that the toilet brush 1 has a handle 5 and a head 7 at one end of the handle 5. The head 7 is preferably formed with bristles and is generally half hemispherical in shape. Heads of this type are well known in toilet brush arts. Instead of the head 7 being of bristles it may be of configurations such as of synthetic foam materials or of other wiping pads. The exact nature of the head is not critical to the inventive concept.

The handle 5, the base 3, and bristles 7 are all formed from a plastics material. FIG. 2 clearly shows the construction of the toilet brush 1. Here it can be seen that the handle 5 has a hand gripping part 9, an intermediate part 11, and a head core 13. The remote or free end of the hand gripping part 9 has a screw threaded end cover 15 which can be used to allow a liquid such as disinfectant or detergent or cleaning fluid to be placed within the hollow body of the handle 5. An outlet 17 is provided in the handle 5 to permit the liquid within the hollow handle 5 to be dispensed during operation of the toilet brush 1. The liquid within the hollow handle 5 can be dispensed by operation of a valve (shown generally as valve 19). Details of the valve 19 will be explained hereafter. A dispensing operator 21 is carried by the handle 5 so that when the dispensing operator is moved to dispense liquid, such as being engaged with the inside of the toilet bowl or toilet bowl rim, the valve 19 will operate to allow liquid to be discharged from the outlet 17.

FIG. 2 clearly shows that a hand gripping part 9 is snap lock fittable within a central bore part of the intermediate part 11. Here, the intermediate part 11 has an internal groove 23, and the intermediate part 11 has a corresponding mating peripheral snap lock rib 25. An "O" ring seal 27 is provided to provide a fluid type seal.

The head 7 is snap lock fittable into a lower end of the intermediate part 11. Here, the head core 13 contains a circumferential groove 29, and the internal surfaces of the intermediate part 11 at the head end contain a peripheral snap lock rib 31.

A "duck" valve 33 is provided on the end cover 15 and allows air to pass through an opening 35 in the end cover 15, through the "duck" valve 33, and into the hollow interior of the handle 5. Thus, as liquid is dispensed from the outlet 17, air can be introduced into the hollow handle 5 to compensate for the volume of liquid displaced. In other words, this provides a neutral pressure differential between the inside of the hollow handle 5 and atmospheric pressure.

FIG. 2 also shows that the dispensing operator 21 is pivoted to the intermediate part 11 at pivot pin 36. Thus, as the dispensing operator 21 is pressed or otherwise engaged with the internal surfaces of the toilet bowl or the rim of the toilet bowl, the dispensing operator 21 will swing in a direction inwardly of the circumferential surfaces of the intermediate part 11. This, in turn, will cause a pressing pin 37 to effect operation of the valve 19. This will be explained in more detail hereinafter.

Referring now to FIGS. 3-6, it can be seen that the intermediate part 11 is formed with a cut-out part 38 in which the dispensing operator can be received. The cut-out part 38 contains transverse pivot pin bores 39 to receive the pivot pin 36 of the dispensing operator 21. The hollow interior of the intermediate part 11 is stepped inwardly at region 41 (see FIG. 6) whilst at the same time providing liquid communication from the hollow interior of the handle 5 to the valve 19 so that the liquid can be dispensed from the outlet 17. The intermediate part 11 has a valve body 43 formed therein at the lowermost end of region 41. A bore 45 extends through the body 43 in a direction transverse to the central longitudinal axis of intermediate part 11. The outlet 17 is formed in a partly hemispherical swelling 47 of the outside surfaces of the intermediate part 11 directly opposite the bore 45. The body 43 therefore provides a stationary gate part 49 of the valve 19. A liquid dispensing passage 51 passes through the body 43 and communicates with the bore 45 and is funnel shaped, although this is not essential. The end of the bore 45 remote from the outlet 17 is provided with a seat 53. This will be referred to in due course. The valve 19 is therefore in a liquid dispensing passage through which liquid can pass from the handle 5 to the outlet 17.

Referring now to FIGS. 7-10 there are shown views depicting the dispensing operator 21. Here, the dispensing operator 21 has a central body part 54 which has its external surfaces curved to the same profile as the profile of the outer surfaces of the handle 5 (and the intermediate part 11). The dispensing operator 21 has an uppermost shoulder 55 which extends laterally outwardly therefrom so that it is proud of the outermost face of the body 54. The lowermost end of the dispensing operator 21 has a pair of protruding arms 57 which each contain axle bores 59. The pivot pin 36 (see FIG. 2) can be passed through these axle bores 59 to hold the dispensing operator 21 fixed relative to the handle 5. FIG. 2 clearly shows that the lowermost end 61 of the dispensing operator 21 limits the amount of outward swinging of the dispensing operator 21 from the handle 5. Thus, when the dispensing operator 21 is mounted relative to the handle 11, it can swing only inwardly in a direction radially inwardly transversely across the handle 11. It can then swing back again. Three protruding ribs 63 are provided on the outer surface of the dispensing operator 21 at a position below the shoulder 55. These ribs 63 are provided to provide a gripping surface to the outside of the dispensing operator 21 so that if the dispensing operator 21 is engaged with a corner of the rim of the inside of the toilet bowl, it will assist in transferring motion to the dispensing operator 21 to cause operation of the valve 19. The shoulder 55 also provides a protruding surface to the dispensing operator 21 in the event that the dispensing operator 21 is engaged with the internal lowermost surfaces on the inside of a toilet bowl.

Figure 11:
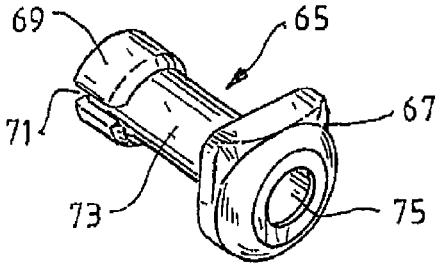
FIG. 11 is a perspective view of a sliding gate part of a control valve.
Figure 12:
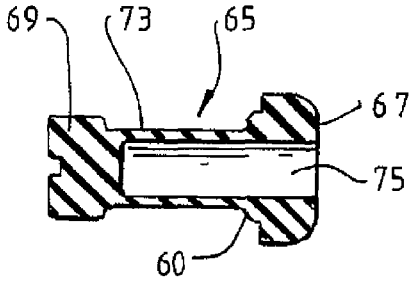
FIG. 12 is a vertical cross sectional of the sliding gate part shown in FIG. 11.
Figure 13:
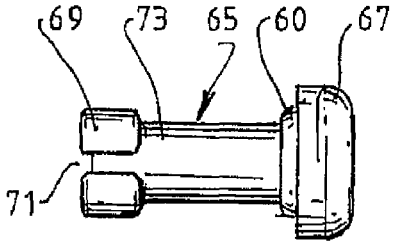
FIG. 13 is a side elevational view of the sliding gate part shown in FIGS. 11 and 12.

Referring now to FIGS. 11-13, there are shown details of a sliding gate part 65 of the valve 19. Here, the sliding gate part 65 is manufactured from a synthetic plastics material that will permit the sliding gate part to be elongated longitudinally. Thus, when the dispensing operator 21 is operated, the sliding gate part 65 can be elongated longitudinally to cause operation of the valve. The sliding gate part 65 is typically made from a silicon rubber. Here it can be seen that it has a generally cylindrical configuration that has a head 67 that can be held stationary within the valve 19. The head 67 is provided with an annular step 60 to assist pressure fitting and holding of the sliding gate part 65 stationary at its head end relative to the valve, to inhibit against unwanted dislodgment in a radially outward direction. At the other end there is a smaller diameter head 69. The head 67 is arranged to engage with the seat 53. The head 69 is a sliding frictional fit within the bore 45 of the valve 19 and includes a liquid passageway 71 extending therethrough which will allow liquid from the hollow handle to pass through the valve 19 and from the outlet 17. The head 69 is also of larger diameter than a main body part 73 of the sliding gate part 65. A hollow bore 75 extends from the head 67 end towards the opposite head 69 end to receive the pressing pin 37. The pressing pin 37 engages with inside surfaces 40 of the dispensing operator 21, and with inside surfaces of the bore 75 at the head end 69 (see FIG. 2). Because the sliding gate part 65 is made from a material that will permit it to be elongated longitudinally, then the head 69 can move transversely across the longitudinal extent of the handle 11 within the valve 19 and cause operation of the valve 19.

Figure 14:
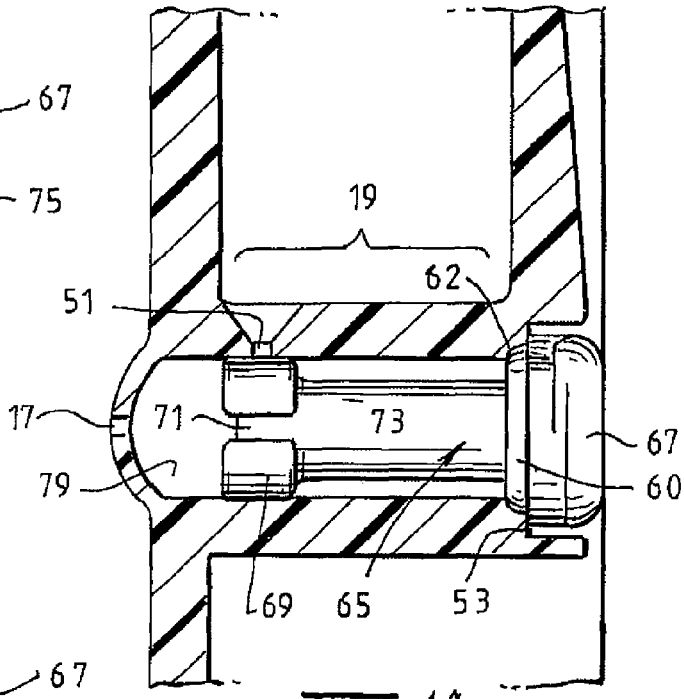
FIG. 14 is a close up longitudinal cross sectional view showing the valve in a closed condition.
Figure 15:
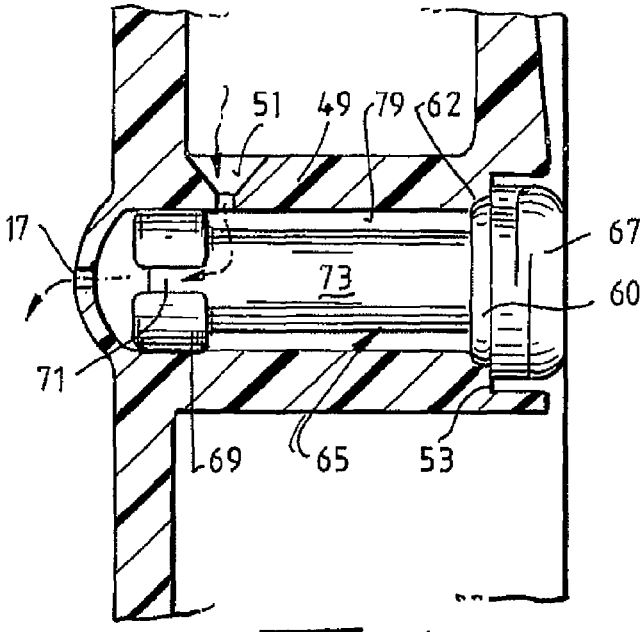
FIG. 15 is a view similar to that of FIG. 14 showing the valve in a position where liquid can be dispensed.

Referring now in detail to FIGS. 14 and 15, it can be seen how the valve 19 operates. Here, under conditions where the dispensing operator 21 is not operated, the head 69 of the sliding gate part 65 assumes a position where it is closing the liquid dispensing passage 51 of the stationary gate part 49. When the dispensing operator 21 is operated to permit liquid to be dispensed, then the sliding gate part 65 is caused to be elongated longitudinally by the pressing pin 37 pressing within the bore 75 against the head end 69. This, in turn, slides the head 69 to a position past the liquid dispensing passage 51 (see FIG. 15). Here, liquid within the hollow handle 11 can pass through the liquid dispensing passage 51, into a space 79 between the head 69 and the head 67, and then through liquid passage 71 in the head 69, and then from the outlet 17. This is diagrammatically shown in FIG. 15 where it can be seen that the sliding gate part 65 has been elongated relative to that shown in FIG. 14. It should also be appreciated that the sliding gate part 65 moves past the stationary gate part 49 (and the liquid dispensing passage 51) and effects a sliding wiping cleaning of the valve 19. This, in turn, ensures that the valve 19 is kept clean and free for flow of liquid from the handle 11 through the outlet 17. The resiliency of the elongated sliding gate part 65 causes the sliding gate part 65 to subsequently return to its original un-elongated condition, and returns the dispensing operator 21 to its original position. The resiliency therefore provides a bias to the dispensing operator 21 to return to its original position.

The bore 79 has a circumferential groove 62 provided at the end that receives the head 67. Here a part of the step 60 can deform into the groove 62 to assist in the holding of the head 67 stationary within the bore 79 to inhibit against unwanted outward dislodgement of the sliding gate part 65.

Typically, the liquid within the handle 5 is a disinfectant liquid. One such liquid is sold under the trade mark PINE-O-CLEAN. It has been found that a disinfectant of this type is very suitable for use in cleaning toilets and is inexpensive. It has also been found that such disinfectant tends to crystallise at any valve openings after an extended period. Thus, the sliding wiping action of the valve 19 minimises the likelihood of crystal build up at the liquid dispensing passage 51, particularly as the liquid dispensing passage 51 is closed to atmospheric air when the valve 19 is not operated. This, in turn, also inhibits crystal formation. The sliding wiping action further assists cleaning of the surfaces of the stationary gate part 49 and the sliding gate part 65. The outlet 17 does not tend to be clogged by crystal build-up as outlet 17 is flushed by water in the toilet bowl and therefore is not subject to direct contact with the disinfectant after use.

In use, the handle is held in a generally upright position within the toilet bowl so that the liquid within the handle 5 is at the bottom of the hollow interior of the intermediate part 11. Thus, there is always a liquid covering the liquid dispensing passage 51. The liquid can then flow by gravity through the valve 19 and from outlet 17 upon operation of the dispensing operator 21. The liquid will then fall into the toilet bowl and be mixed with water within the toilet bowl to facilitate application of the liquid to the interior surfaces of the toilet bowl.

The diameter of the openings for the liquid dispensing passage 51 and the outlet 17 are typically 1 millimeter in diameter. This is merely exemplary and is not meant to be exhaustive. Typically, the volume of liquid held within the hollow handle is approximately 130 milliliters. Again, this is not meant to be exhaustive.

FIG. 1 shows an optionally provided elongate liquid level sight gauge window 81 formed in the handle. Here, the handle 5 may be moulded from a translucent or transparent plastics material. This enables the liquid level sight gauge window 83 to be economically formed within the handle 5. The external surfaces of the handle 5 may be slightly corrugated as shown to facilitate gripping. A plastics covering may be applied around the handle 5, but not over the liquid level sight gauge window 81, to facilitate gripping.

Advantages of the example of the toilet brush shown are that the liquid is held within the handle and is convenient for use. There is nothing attached external to the toilet brush to facilitate dispensing of liquid. Further, there are no hoses or other pipes to permit the dispensing of the liquid. The user can control the amount of liquid dispensed by the number of times, or the pressing time, that the dispensing operator 21 is engaged with the internal surfaces of the toilet bowl. Further, an inexpensive disinfectant can be used as the liquid.

Whilst the handle has been shown hollow so that the cleaning liquid may be filled directly into the hollow interior, the cleaning liquid may be provided in a cartridge container that can be inserted directly into the hollow interior to thereby avoid messy filling procedures where the cleaning liquid could otherwise accidentally spill during filling of the handle. In a further variation the handle may not be hollow, and the cartridge may be attachable to external surfaces of the handle. In such case an appropriate connection can be made to the cartridge to allow the cleaning liquid to be dispensed from the valve.

Whilst the outlet 17 has been shown displaced from the head 7, it should be appreciated that the outlet 17 may be positioned at any desired location along the length of the handle 5 below the uppermost or free end, such as within the content of the head 7 itself.

Whilst the present invention has been disclosed specifically with example to a toilet brush it should be appreciated that it may be applicable to other brushes such as brushes for windows, mops, and can be utilised for such tools where there are either bristles, pads or foam or like surfaces.

The invention may also be incorporated into paint brushes that contain paint as the liquid. The invention could also be incorporated into rakes or combs or toothbrushes, or similar where a liquid is to be dispensed during operation. All such tools are to be considered within the scope of the invention.

These and other modifications may be made without departing from the ambit of the invention and nature of which is to be determined from the foregoing description.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A cleaning tool, comprising: a head and a handle extending from said head, said handle carries a liquid that is dispensed therefrom to provide a dispensed liquid useable during operation of the cleaning tool, said handle including a liquid dispensing passage through which said liquid passes to a liquid outlet during liquid dispensing, said passage having a valve for controlling a passage of said liquid, said valve including a sliding gate part and a stationary gate part, said sliding gate part being positionable relative to said stationary gate part to block the flow of liquid when in one position, and to be positionable relative to said stationary gate part in another position to permit the flow of liquid, said sliding gate part effecting a sliding wiping cleaning of the valve during movement from said one position to said another position, and wherein said sliding gate part is an elongate part that is held stationary at one end relative to the stationary gate part, and which is elastically stretched longitudinally by a pressing pin so the other end will slide relative to the stationary gate part to open the valve and permit the flow of liquid so liquid is dispensed from said outlet, and the sliding gate part being of a resilient material to allow it to be elastically stretched, said resiliency permitting the sliding gate to elastically return to a position to close said valve when the force applied externally by the pressing pin is removed.

2. A cleaning tool, as claimed in claim 1, and being a toilet brush and wherein said handle is an elongate handle adapted to be held in an upright disposition during use, and wherein said outlet is at a head end of the brush.

3. A cleaning tool, as claimed in claim 2, wherein said valve has the sliding gate part mounted so that it slides in a direction across the handle and generally perpendicular to a longitudinal central axis of said handle.

4. A cleaning tool, as claimed in claim 3, wherein said sliding gate part caused to slide by being associated with a dispensing operator carried by said handle, so that when said dispensing operator is moved to dispense liquid, said sliding gate part will slide relative to said fixed gate part.

5. A cleaning tool, as claimed in claim 4, wherein said dispensing operator is a swingable arm pivoted to said handle and wherein pressing of said swingable arm enables liquid to be dispensed.

6. A cleaning tool, as claimed in claim 1, wherein said elongate part is of a plastics material.

7. A cleaning tool, as claimed in claim 1, wherein said elongate part has a head part at said other end, and wherein said valve permits the flow of liquid when said head part slides in the same direction in which said dispensing operator moves when liquid is dispensed.

8. A cleaning tool, as claimed in claim 7, wherein said head part has a liquid passageway therein, so that when said head part is pushed sufficiently past said stationary gate part, liquid flows from said handle into a space between said head part and the other end of said elongate part, and thereafter through said liquid passageway to said outlet.

9. A cleaning tool, as claimed in claim 7, wherein said outlet is in said handle at a position adjacent the head.

10. A cleaning tool, as claimed in claim 7, wherein an end of the handle remote from the head has a removable end cover for liquid to be introduced into the handle, and which end cover is replaced to contain the liquid within the handle.

11. A cleaning tool, as claimed in claim 10, wherein the end cover carries a duck bill valve to permit air to enter the handle as liquid is dispensed.

12. A cleaning tool, as claimed in claim 2, wherein said handle has a liquid level sight window extending along a part of longitudinal extent of the outer surface thereof, to enable a volume level of liquid in the handle to be determined.

* * * * *